US006508542B2

(12) United States Patent
Sharma et al.

(10) Patent No.: US 6,508,542 B2
(45) Date of Patent: Jan. 21, 2003

(54) INK DROP DEFLECTION AMPLIFIER MECHANISM AND METHOD OF INCREASING INK DROP DIVERGENCE

(75) Inventors: Ravi Sharma, Fairport, NY (US); Todd R. Griffin, Rochester, NY (US); Milton S. Sales, Webster, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/751,483

(22) Filed: Dec. 28, 2000

(65) Prior Publication Data

US 2002/0085072 A1 Jul. 4, 2002

(51) Int. Cl.[7] ..... B41J 2/09; B41J 2/105; B41J 2/02

(52) U.S. Cl. ..... 347/77; 347/82

(58) Field of Search ..... 347/74, 75, 76, 347/77, 78, 82

(56) References Cited

U.S. PATENT DOCUMENTS

| | | | | |
|---|---|---|---|---|
| 3,579,245 A | | 5/1971 | Berry | |
| 3,596,275 A | | 7/1971 | Sweet | |
| 3,709,432 A | | 1/1973 | Robertson | |
| 3,878,519 A | | 4/1975 | Eaton | |
| 4,050,077 A | | 9/1977 | Yamada et al. | |
| 4,068,241 A | * | 1/1978 | Yamada | 347/77 |
| 4,107,699 A | | 8/1978 | Kenworthy | |
| 4,190,844 A | | 2/1980 | Taylor | |
| 4,364,057 A | | 12/1982 | Ebi et al. | |
| 4,520,366 A | | 5/1985 | Cragin, Jr. | |
| 5,105,205 A | | 4/1992 | Fagerquist | |
| 5,469,202 A | | 11/1995 | Stephens | |
| 5,966,154 A | | 10/1999 | DeBoer | |
| 6,079,821 A | | 6/2000 | Chwalek et al. | |

FOREIGN PATENT DOCUMENTS

| | | | | |
|---|---|---|---|---|
| EP | 0494385 | | 7/1992 | |
| EP | 1016526 | * | 7/2000 | 347/77 |
| WO | WO 81/03149 | * | 11/1981 | 347/77 |

* cited by examiner

*Primary Examiner*—Huan Tran
(74) *Attorney, Agent, or Firm*—William R. Zimmerli

(57) ABSTRACT

An ink drop deflector mechanism is provided. The ink drop deflector mechanism includes an ink drop source and a path selection device operable in a first state to direct drops from the source along a first path and in a second state to direct drops from the source along a second path. The first and second paths diverge from the source. The mechanism also includes a system which applies force to drops travelling along at least one of the first and second paths with the force being applied in a direction so as to increase the divergence of the paths. The mechanism may include a gas source which generates a gas flow force that is applied in a direction that increases the divergence of the paths. The gas flow may be positioned between the first and second paths. The gas flow may be substantially laminar and interact with at least one of the first and second paths as the gas flow loses its coherence. The mechanism may also include a catcher with at least a portion of the system being positioned adjacent the catcher. Alternatively, at least a portion of the system may be integrally formed in the catcher.

16 Claims, 6 Drawing Sheets

INK DROP DEFLECTION AMPLIFIER MECHANISM AND METHOD OF INCREASING INK DROP DIVERGENCE

FIELD OF THE INVENTION

This invention relates generally to the field of digitally controlled printing devices, and in particular to continuous ink jet printers in which a liquid ink stream breaks into drops, some of which are selectively deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet.

Conventional continuous ink jet printheads utilize electrostatic charging tunnels that are placed close to the point where the drops are formed in a stream. In this manner individual drops may be charged. The charged drops may be deflected downstream by the presence of deflector plates that have a large potential difference between them. A catcher (sometimes referred to as a "gutter", an "interceptor", or a "collector") may be used to intercept either the charged or the uncharged drops, while the non-intercepted drops are free to strike a receiver or recording medium. U.S. Pat. No. 3,878,519, issued to Eaton on Apr. 15, 1975, and U.S. Pat. No. 4,050,077, issued to Yamada et al. on Sep. 20, 1977, disclose devices for synchronizing drop formation in a liquid stream using electrostatic deflection by a charging tunnel and deflection plates. These devices require large spatial distances (sometimes referred to as "ink drop trajectory distance") between the printhead and the recording medium because the charging tunnel and deflection plates must be accommodated for within the device. As the amount of ink drop deflection is small, the ink drops need to travel over these large spatial distances in order to deflect enough to strike the recording medium (or the catcher). Ink drop placement accuracy is adversely affected when ink drops travel over large spatial distances because there is a greater risk of the drops being interfered within a manner that alters the drops' path.

Alternatively, continuous ink jet printers may incorporate the charging tunnel and deflection plates in other printer components. U.S. Pat. No. 5,105,205, issued to Fagerquist on Apr. 14, 1992, and U.S. Pat. No. 5,469,202, issued to Stephens on Nov. 21, 1995, disclose devices of this type. Individual ink drops receive an electrical charge. An opposite electrical charge is applied to the surface of a catcher parallel to the normal trajectory of the ink stream. The opposite polarities create an attraction force that deflects the drops toward and onto the surface of the catcher. However, the amount of deflection is small. This configuration also requires large spatial distances between the printhead and the recording medium. This adversely affects ink drop trajectory distance as discussed above. As such, there is a need to minimize the distance an ink drop must travel before striking the print media in order to insure high quality images.

Referring to FIG. 2A, a printhead 200 includes a pressurized ink source 202 and a selection device 204. Printhead 200 is operable to form selected ink drops 206 and non-selected ink drops 208. Selected ink drops 206 flow along a selected ink path 210 ultimately striking recording medium 212, while nonselected ink drops 208 flow along a non-selected ink path 214 ultimately striking a catcher 216. Non-selected ink drops 208 are recycled or disposed of through an ink removal channel 218 formed in catcher 216. U.S. Pat. No. 6,079,821, issued to Chwalek et al. on Jun. 27, 2000 discloses an ink jet printer of this type.

While the ink jet printer disclosed in Chwalek et al. works extremely well for its intended purpose, ink drop path divergence (shown generally at 220), also commonly referred to as ink drop divergence angle (shown generally at angle A) or ink drop discrimination, between selected ink drops 206 and non-selected ink drops 208 is small. This, combined with other printhead environmental operating factors (inconsistent ink drop deflection 221 due to ink build up around heater 204, etc.), increases the potential for ink 222 to build up on catcher 216. As ink 222 builds up on catcher 216, selected ink drops 206 flowing along selected ink path 210 may be interfered with resulting in reduced image quality. As such, there is a need to increase ink drop path divergence in order to insure high quality images.

Continuous ink jet printers (page width, scanning, etc.) using electrostatic means to affect ink drop trajectory also experience ink build up on catcher surfaces. Ink that has built up on the catcher can become contaminated with paper dust, dirt, debris, etc., due to the operating environment of the printer. This causes clogging of the catcher. When this happens, the catcher must be thoroughly cleaned prior to operating the ink jet system. Additionally, contaminated ink must be cleaned before the ink can be reused, adding to the overall cost and expense of an ink jet system. As such, there is a need to increase ink drop path divergence in order to reduce printhead maintenance and ink cleaning.

U.S. Pat. No. 3,709,432, which issued to Robertson, discloses a method and apparatus for stimulating a filament of working fluid causing the working fluid to break up into uniformly spaced drops through the use of transducers. The lengths of the filaments before they break up into drops are regulated by controlling the stimulation energy supplied to the transducers, with high amplitude stimulation resulting in short filaments and low amplitudes resulting in long filaments. A flow of air is generated across the paths of the fluid at a point intermediate to the ends of the long and short filaments. The air flow affects the trajectories of the filaments before they break up into drops more than it affects the trajectories of the drops themselves. By controlling the lengths of the filaments, the trajectories of the drops can be controlled, or switched from one path to another. As such, some drops may be directed into a catcher while allowing other drops to be applied to a receiving member.

While this method does not rely on electrostatic means to affect the trajectory of drops it does rely on the precise control of the break off points of the filaments and the placement of the air flow intermediate to these break off points. Such a system is difficult to manufacture. Furthermore, the physical separation or amount of discrimination between the two drop paths is small increasing the difficulty of controlling printed and non-printed ink drops resulting in at least the ink drop build up problem discussed above.

U.S. Pat. No. 4,190,844, issued to Taylor on Feb. 26, 1980, discloses a continuous ink jet printer having a first pneumatic deflector for deflecting non-printed ink drops to a catcher and a second pneumatic deflector for oscillating printed ink drops. The first pneumatic deflector is an "on/off" or an "open/closed" type having a diaphram that either opens or closes a nozzle depending on one of two distinct electrical signals received from a central control unit. This determines whether the ink drop is to be printed or non-printed. The second pneumatic deflector is a continuous type having a diaphram that varies the amount a nozzle is open depending on a varying electrical signal received the central control unit. This oscillates printed ink drops so that characters may be printed one character at a time. If only the first pneumatic deflector is used, characters are created one line at a time, being built up by repeated traverses of the printhead.

While this method does not rely on electrostatic means to affect the trajectory of drops it does rely on the precise control and timing of the first ("open/closed") pneumatic deflector to create printed and non-printed ink drops. Such a system is difficult to manufacture and accurately control resulting in at least the ink drop build up discussed above. Furthermore, the physical separation or amount of discrimination between the two drop paths is erratic due to the precise timing requirements increasing the difficulty of controlling printed and non-printed ink drops resulting in poor ink drop trajectory control and at least the ink drop build up discussed above.

Additionally, using two pneumatic deflectors complicates construction of the printhead and requires more components. The additional components and complicated structure require large spatial volumes between the printhead and the media, increasing the ink drop trajectory distance. Increasing the distance of the drop trajectory decreases drop placement accuracy and affects the print image quality. Again, there is a need to minimize the distance the drop must travel before striking the print media in order to insure high quality images.

It can be seen that there is a need to provide a simply constructed enhanced ink drop deflector that reduces printhead maintenance; increases ink drop spacing; increases image quality; reduces the distance an ink drop must travel; and reduces the amount of vacuum required to remove non-printed ink drops.

SUMMARY OF THE INVENTION

It is an object of the present invention to provide an ink drop deflection amplifier that increases ink drop path divergence between selected and non-selected ink drops.

It is another object of the present invention to provide an ink drop deflection amplifier that reduces the distance a selected ink drop must travel before striking a recording medium.

It is another object of the present invention to provide an ink drop deflection amplifier of simple construction.

It is still another object of the present invention to provide an ink drop deflection amplifier that reduces printhead maintenance.

It is still another object of the present invention to provide an ink drop deflection amplifier that reduces ink contamination.

It is still another object of the present invention to provide an ink drop deflection amplifier that improves image print quality.

According to a feature of the present invention, an ink drop deflector mechanism includes an ink drop source and a path selection device operable in a first state to direct drops from the source along a first path and in a second state to direct drops from the source along a second path. The first and second paths diverge from the source. The mechanism also includes a system which applies force to drops travelling along at least one of the first and second paths with the force being applied in a direction so as to increase the divergence of the paths.

According to another feature of the present invention, the mechanism may include a gas source which generates a gas flow force that is applied in a direction that increases the divergence of the paths. The gas flow may be positioned between the first and second paths. The gas flow may also be substantially laminar. Additionally, the gas flow may interact with at least one of the first and second paths as the gas flow loses its coherence.

According to another feature of the present invention, the mechanism may also include a catcher. At least a portion of the system may be positioned adjacent the catcher. Alternatively, at least a portion of the system may be integrally formed in the catcher or positioned internally in the catcher.

According to another feature of the present invention, a method of increasing ink drop divergence includes providing a source of ink drops; directing the ink drops to travel in a first state along a first path and in a second state along a second path, the first and second paths diverging from the source; and causing the divergence of the paths to increase. The method may include applying a force to drops travelling along at least one of the first and second paths in order to cause the divergence of the paths to increase.

According to another feature of the present invention, the method may include generating a gas flow and applying the gas flow to drops travelling along at least one of the first and second paths in a direction that increases the divergence of the paths.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
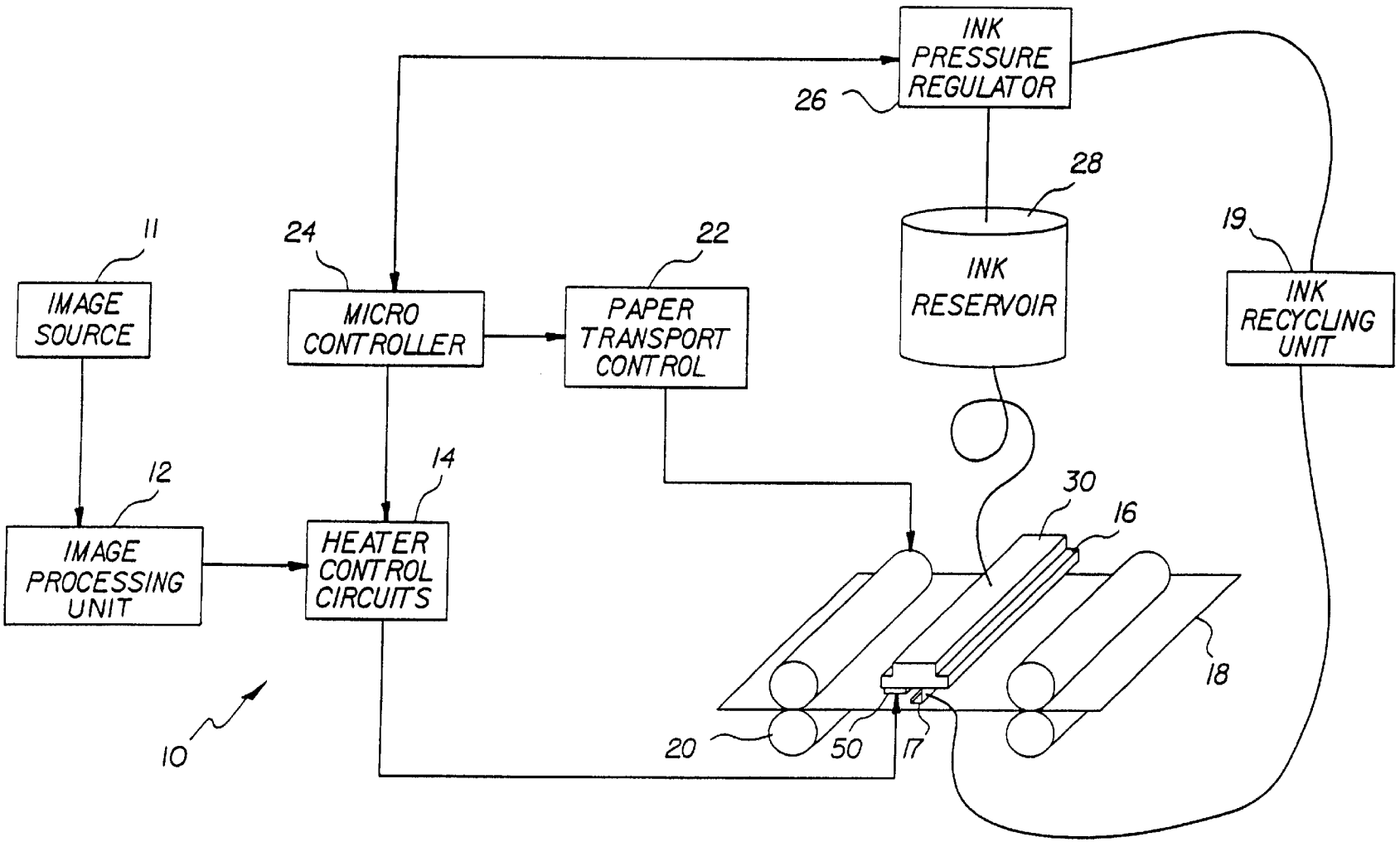
FIG. 1 is a simplified block schematic diagram of one exemplary printing apparatus according to the present invention.

Referring to FIG. 1, an asymmetric heat-type continuous ink jet printer system 10 includes an image source 11 such as a scanner or computer which provides raster image data, outline image data in the form of a page description language, or other forms of digital image data. This image data is converted to half-toned bitmap image data by an image processing unit 12 which also stores the image data in memory. A heater control circuit 14 reads data from the image memory and applies electrical pulses to a heater 50 that applies heat to a nozzle that is part of a printhead 16. These pulses are applied at an appropriate time, and to the appropriate nozzle, so that drops formed from a continuous ink jet stream will print spots on a recording medium 18 in the appropriate position designated by the data in the image memory.

Recording medium 18 is moved relative to printhead 16 by a recording medium transport system 20 which is electronically controlled by a recording medium transport control system 22, and which in turn is controlled by a microcontroller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 28 under pressure. In the nonprinting state, continuous ink jet drop streams are unable to reach recording medium 18 due to an ink gutter 17 that blocks the stream and which may allow a portion of the ink to be recycled by an ink recycling unit 19. Ink recycling unit 19 reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by apply ing p ressure to ink reservoir 28 under the control of an ink pressure regulator 26.

The ink is distributed to the back surface of printhead 16 by an ink channel device 30. The ink preferably flows through slots and/or holes etched through a silicon substrate of printhead 16 to its front surface where a plurality of nozzles and heaters are situated. With printhead 16 fabricated from silicon, it is possible to integrate heater control circuits 14 with the printhead.

Figure 2A:
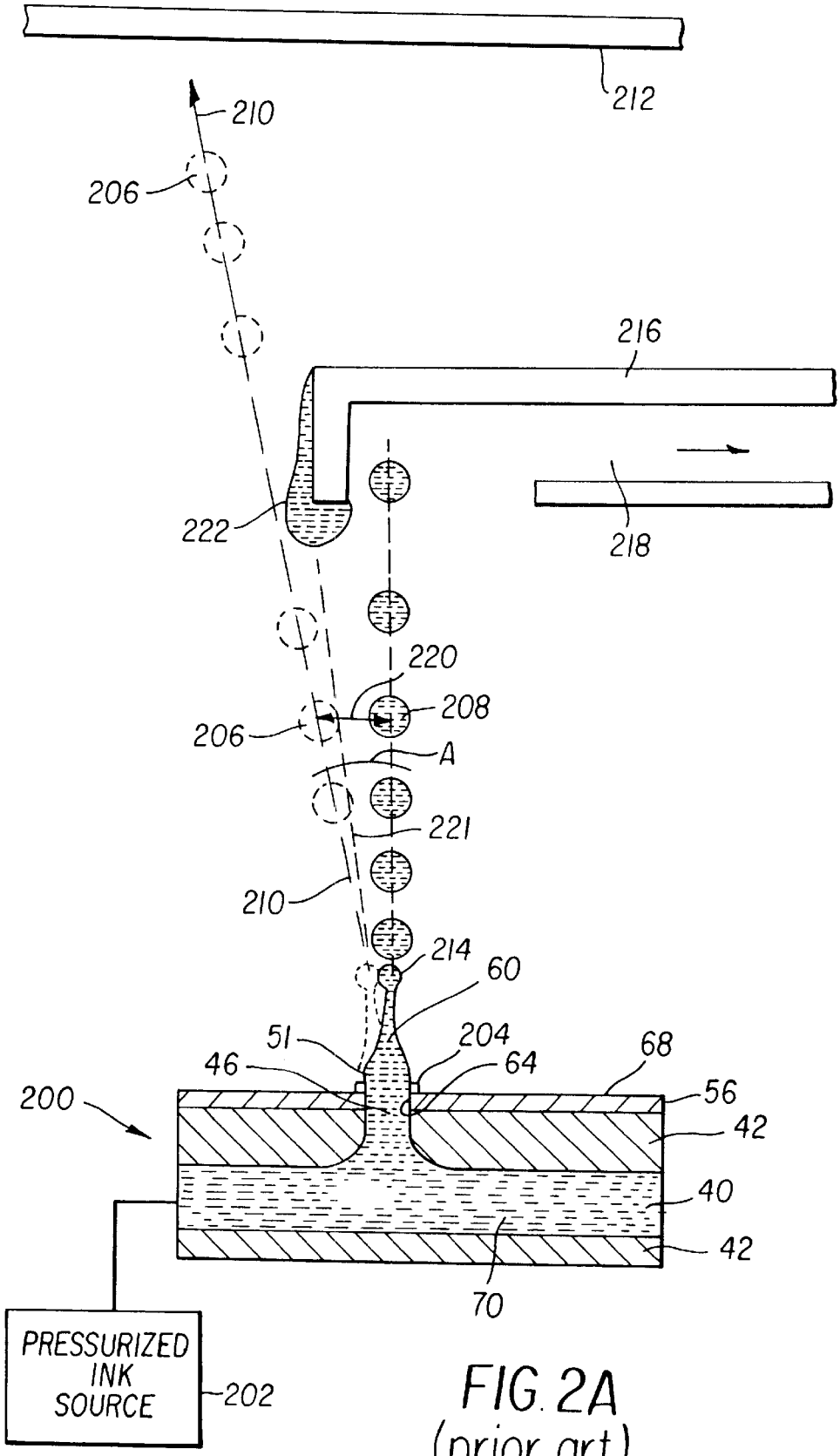
FIG. 2A (prior art)
FIG. 2A is a cross sectional view of a prior art nozzle with asymmetric heating deflection in operation.

FIG. 2A is a cross-sectional view of a tip of a prior art nozzle in operation. An array of such nozzles form the continuous ink jet printhead 16 of FIG. 1. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks into a plurality of drops 66 due to heat supplied by a selection device 204.

Figure 2B:
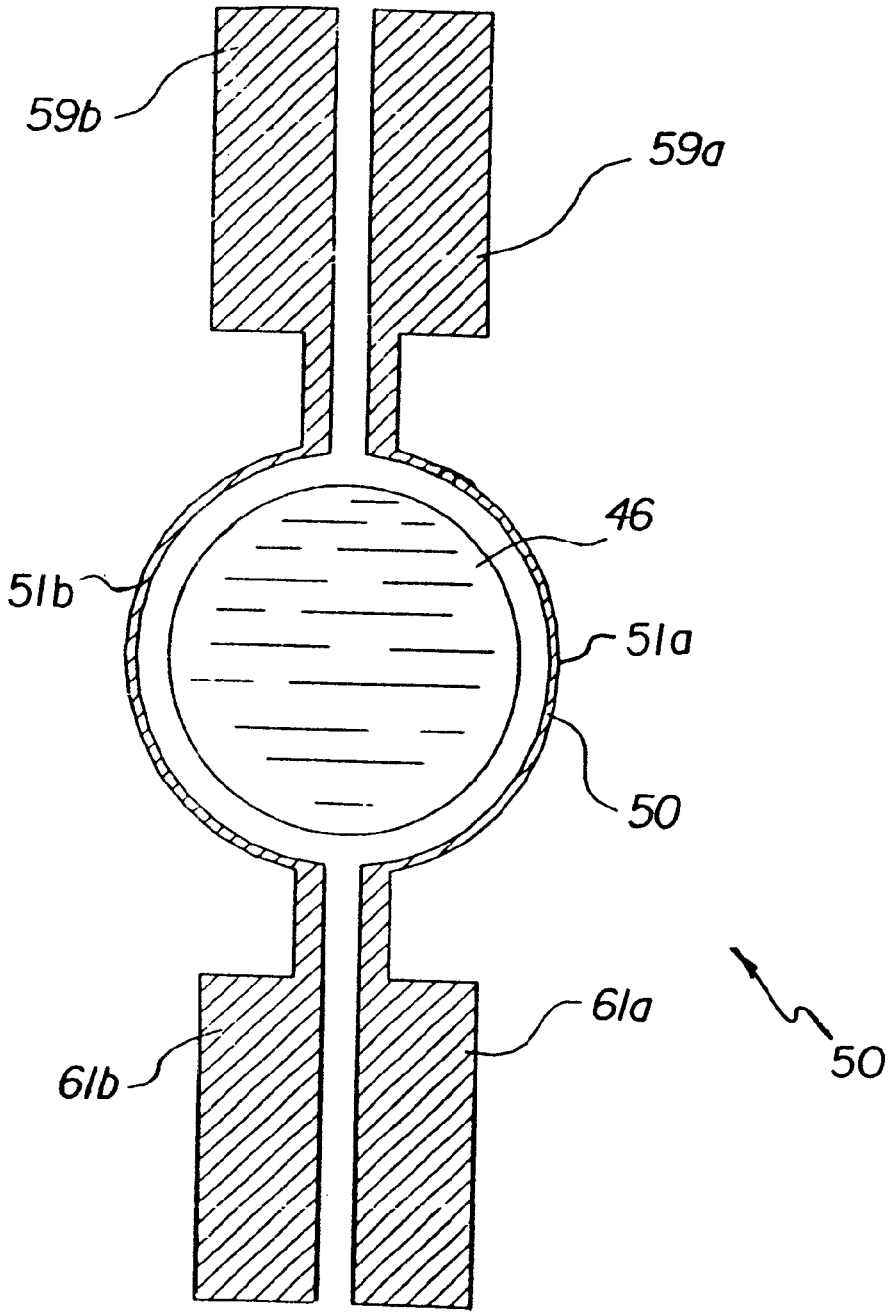
FIG. 2B (PRIOR ART)
FIG. 2B is a plan view of a prior art nozzle having a pair of heating elements disposed on opposite sides thereof.

Referring to FIG. 2B, selection device 204 may include a heater 50. Heater 50 has a pair of opposing semicircular heating elements 51*a*, 51*b* covering almost all of the nozzle perimeter. A plurality of power connections 59*a*, 59*b*, 61*a*, and 61*b* transmit electrical pulses from heater control circuit 14 to heating elements 51*a*, 51*b*, respectively. Heating elements 51*a*, 51*b* of heater 50 may be made of polysilicon doped at a level of about 30 ohms/square, although other resistive heater materials could be used.

Heater control circuit 14 supplies electrical power to heater 50 in the form of electrical pulse trains. Heater control circuit 14 may be programmed to separately supply power to semicircular heating elements 50*a*, 51*b* of heater 50 in the form of pulses of uniform amplitude, width, and frequency to implement the steps of the inventive method. Deflection of an ink drop occurs whenever an electrical power pulse is supplied to one of elements 51*a* and 51*b* of heater 50.

Again referring to FIG. 2A, heater 50 is separated from substrate 42 by a thermal and electrical insulating layer 56 to minimize heat loss to the substrate. Nozzle bore 46 may be etched allowing the nozzle exit orifice to be defined by insulating layers 56. The layers in contact with the ink can be passivated with a thin film layer 64 for protection. The printhead surface can be coated with a hydro-phobizing layer 68 to prevent accidental spread of the ink across the front of the printhead.

Stream 60 is periodically deflected during a printing operation by the asymmetric application of heat generated on the left side of the nozzle bore by heater section 51*a*. This technology is distinct from that of electrostatic continuous stream deflection printers which rely upon deflection of charged drops previously separated from their respective streams. With stream 60 being deflected, undeflected drops 67 may be blocked from reaching recording medium 18 by a cut-off device such as ink gutter 17. In an alternate printing scheme, ink gutter 17 may be placed to block deflected drops 66 so that undeflected drops 67 will be allowed to reach recording medium 18.

Figure 3:
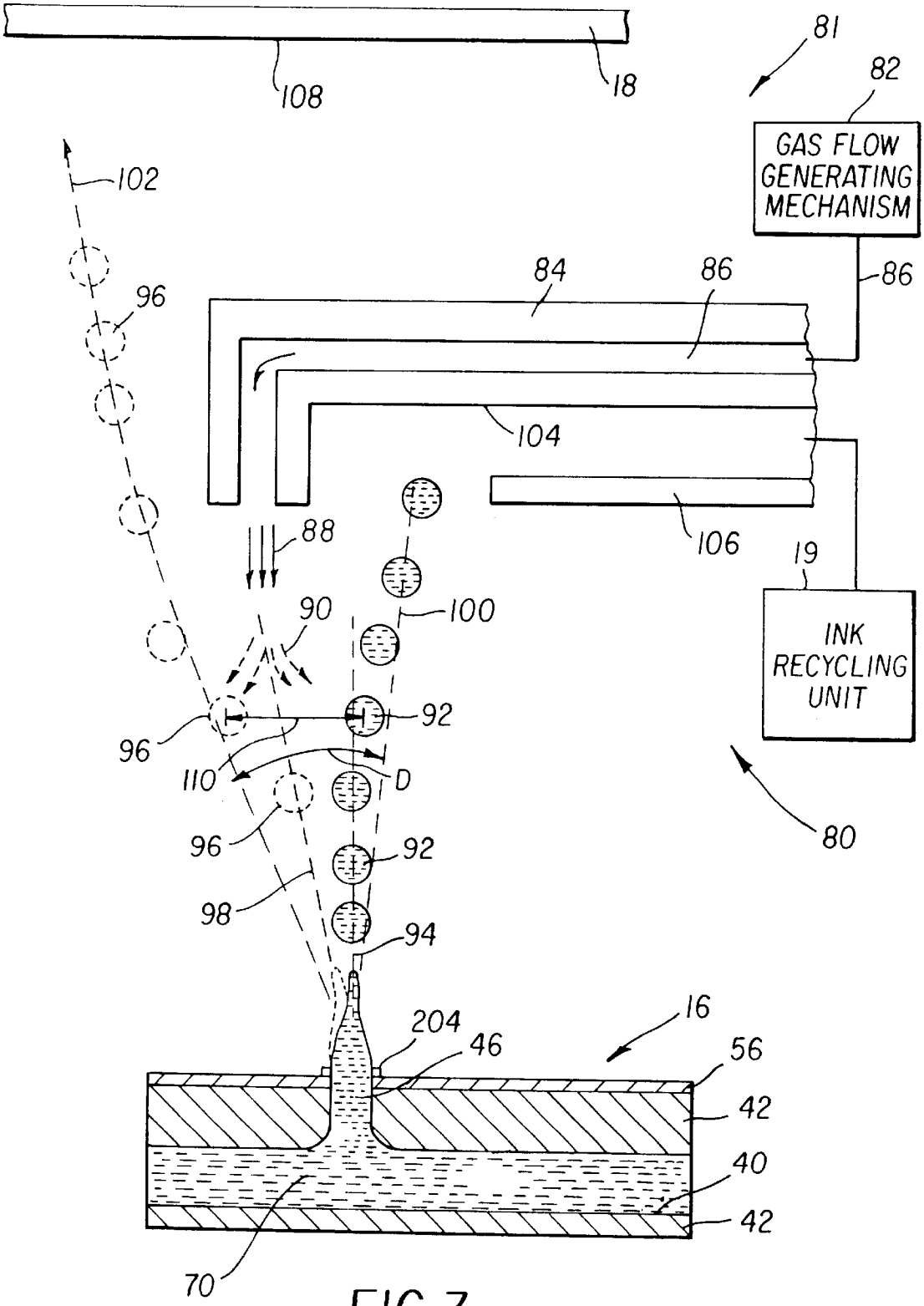
FIG. 3 is a cross sectional view of an enhanced ink drop deflector made according to the present invention.
Figure 4A:
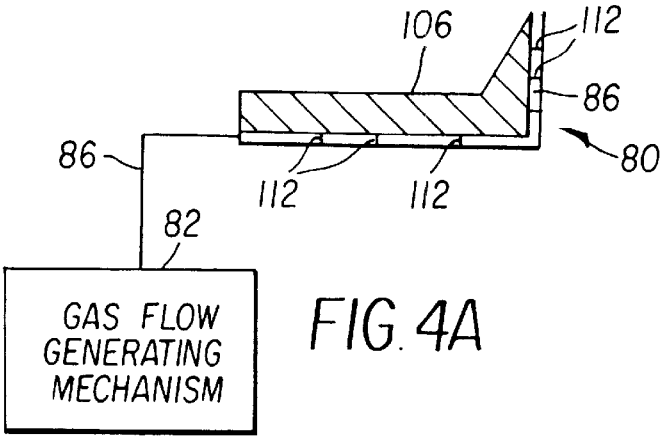
FIG. 4A is a cross sectional view of an alternative embodiment of the invention shown in FIG. 3.
Figure 4B:
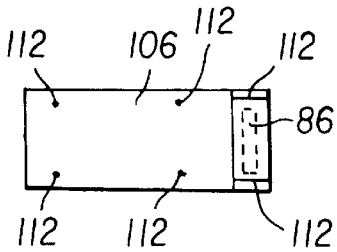
FIG. 4B is a bottom view of the alternative embodiment of the invention shown in FIG. 4A.
Figure 5A:
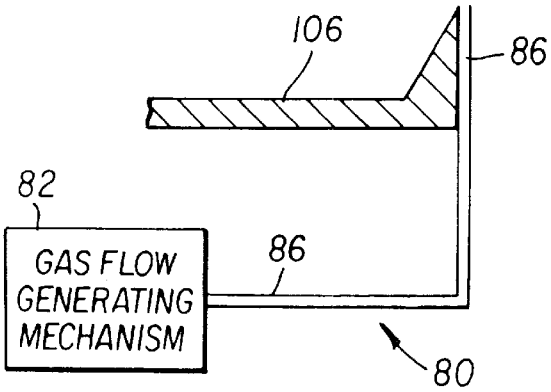
FIG. 5A is a cross sectional view of an alternative embodiment of the invention shown in FIG. 3.
Figure 5B:
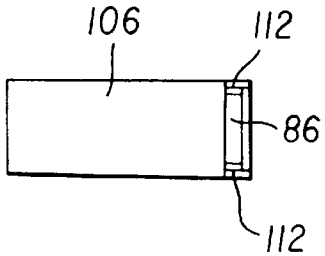
FIG. 5B is a bottom view of the alternative embodiment of the invention shown in FIG. 5A.
Figure 6A:
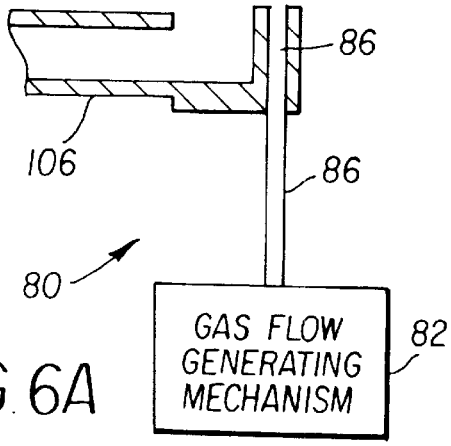
FIG. 6A is a cross sectional view of an alternative embodiment of the invention shown in FIG. 3.
Figure 6B:
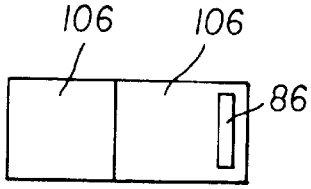
FIG. 6B is a bottom view of the alternative embodiment of the invention shown in FIG. 6A.

Referring to FIG. 3, an ink drop deflection amplifier 80 is shown. Ink drop deflection amplifier 80 (a system) includes a gas source 81 having a flow generating mechanism 82 (a force generator) and a housing 84 defining a gas flow delivery channel 86. Gas flow delivery channel 86 provides a gas flow 88 (a force). Initially, gas flow 88 has dimensions substantially similar to that of gas flow delivery channel 86. For example, a rectangular shaped gas flow delivery channel 86 delivers a gas flow 88 having a substantially rectangular shape. Gas flow 88 is laminar, traveling along an original path (also shown generally at 88). Laminar gas flow 88 eventually loses its coherence and begins to diverge from the original path (shown generally at 90). In this context, the term "coherence" is used to describe gas flow 88 as gas flow 88 begins to spread out or diverge from its original path.

Using selection device 204, as a primary selection device operating as described above, print head 16 is operable to provide a stream of ink drops 91 traveling along a plurality of diverging ink drop paths. Non-selected ink drops 92 travel along a non-selected (first) ink drop path 94 while selected ink drops 96 travel along a selected (second) ink drop path 98. Selected ink drops 96 and non-selected ink drops 92 interact with laminar gas flow 88, generally, as laminar gas flow 88 loses its coherence, shown generally at 90. As a result, non-selected ink drops 92 and selected ink drops 96 are caused to alter original courses and travel along a resulting non-selected ink drop path 100 and a resulting selected ink drop path 102, respectfully. Non-selected ink drops 94 travel along resulting non-selected ink drop path 100 until they strike a surface 104 of catcher 106. Non-selected ink drops 92 are then removed from catcher 106 and transported to ink recycling unit 19. Selected ink drops 96 are allowed to continue traveling along resulting selected ink drop path 102 until they strike a surface 108 of recording medium 18.

In a preferred embodiment, selected ink drops 96 are shown as being allowed to strike recording medium 18 while non-selected ink drops 92 are shown as ultimately striking catcher 106. However, it is specifically contemplated and, therefore within the scope of this disclosure, that selected ink drops 96 can ultimately strike catcher 106 while non-selected ink drops 92 are allowed to strike recording medium 18.

Again, referring to FIG. 3, a resulting ink drop path divergence 110 between selected ink drops 96 and non-selected ink drops 92 is increased (as compared to ink drop path divergence 220 in FIG. 2A). Additionally, a resulting ink drop divergence angle (shown as angle D) between selected ink drops 96 and non-selected ink drops 92 is also increased (as compared to angle A in FIG. 2A). Selected ink drops 96 are now less likely to inadvertently strike catcher 106 resulting in a reduction of ink build up on catcher 106. As ink build up is reduced, print head maintenance and ink cleaning are reduced. Increased resulting ink drop divergence angle D allows the distance selected ink drops 96 must travel before striking recording medium 18 to be reduced because large spatial distances are no longer required to provide sufficient space for selected ink drops 92 to deflect and clear printhead 16 prior to striking recording medium 18. As such, ink drop placement accuracy is improved.

Ink drop deflection amplifier 80 is of simple construction as it does not require charging tunnels or deflection plates. As such, ink drop deflection amplifier 80 does not require large spatial distances in order to accommodate these components. This also helps to reduce the distance selected ink drops 96 must travel before being allowed to strike recording medium 18 resulting in improved drop placement accuracy.

In a preferred embodiment, ink drop deflection amplifier 80 is shown as being integrally formed with catcher 106. However, it is specifically contemplated, and therefore within the scope of this disclosure, that ink drop deflection amplifier 80 can be a separate unit attached to catcher 106 or positioned proximate catcher 106. Additionally, in a preferred embodiment housing 84 is shown as being of rigid construction. However, it is also contemplated, and therefore with the scope of this disclosure, that housing 84 can be made of flexible construction (flexible plastic, tubing, flexible polymer tubing, etc.) with equal results. It is also contemplated, and therefore within the scope of this disclosure, that housing 84 made of flexible construction can be either integrally formed with catcher 106 or attached to catcher 106 with equal results. It is also contemplated, and therefore within the scope of this disclosure, that housing 84 can be a combination of rigid material and flexible material.

Figure 7A:
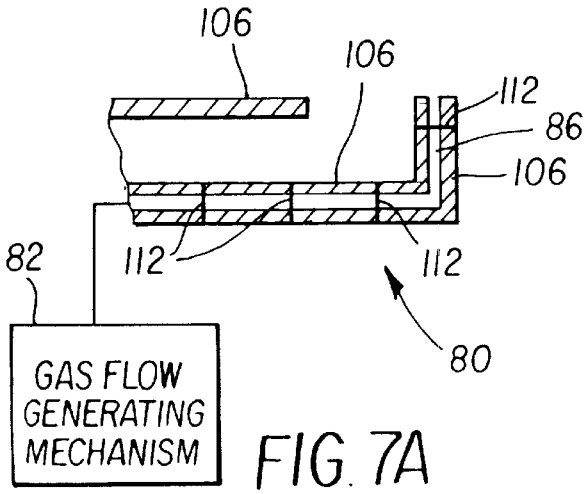
FIG. 7A is a cross sectional view of an alternative embodiment of the invention shown in FIG. 3.
Figure 7B:
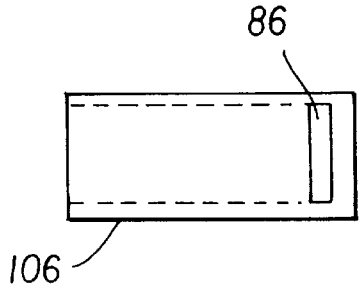
FIG. 7B is a bottom view of the alternative embodiment of the invention shown in FIG. 7A.

Referring to FIGS. 4–7B, alternative embodiments of the present invention are shown. FIGS. 4A and 4B show ink drop deflection amplifier 80 attached to catcher 106 using any known attachment device 112. Attachment device 112 may include screws, clamps, bolts, nails, adhesives, glues, epoxies, etc. FIGS. 5A and 5B show ink drop deflector 80 being made from rigid and flexible material attached to catcher 106 with any known attachment device 112. FIGS. 6A and 6B show ink drop deflection amplifier 80 being made from flexible material and integrally formed with catcher 106. FIGS. 7A and 7B show ink drop deflection amplifier 80 positioned internally in catcher 106. In this embodiment, gas flow delivery channel 86 is positioned adjacent to an inside surface of catcher 106 using any known attachment device 112.

In a preferred embodiment laminar gas flow 88 is air. However, it is specifically contemplated, and therefore within the scope of this disclosure, that other gases can be used with equal results. These gases include nitrogen, gases having different densities and viscosities, etc. Additionally, gas flow 88 is shown as being laminar. However, it is specifically contemplated, and therefore within the scope of this disclosure that gas flow 88 may be delivered in other shapes with equal results. This includes gas flow 88 being delivered in a series of circular tubes, a continuous rectangular trough, a series of individual troughs, etc.

In a preferred embodiment, gas flow generating mechansim 82 is a blower. However, it is specifically contemplated and therefore within the scope of this disclosure that any known type of gas flow generating mechanism 82 may be used with equal results. These gas flow generating mechanisms include a fan, a turbine, electrostatic air moving device, other services for moving air, etc.

Figure 8:
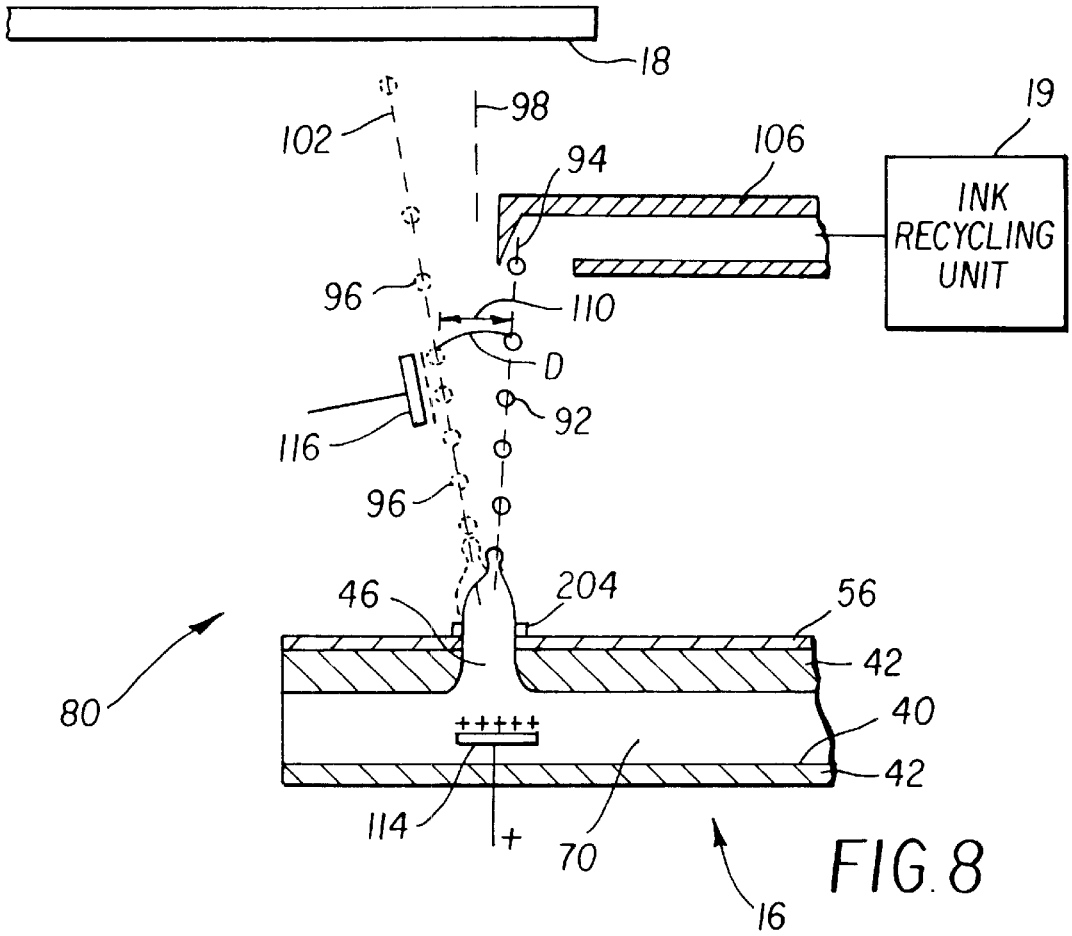
FIG. 8 is a schematic cross sectional view of an alternative embodiment of the present invention.

Referring to FIG. 8, an alternative embodiment of ink drop deflection amplifier 80 is shown. Using selection device 204 as described above, print head 16 is operable to provide a stream of ink drops traveling along a plurality of diverging ink drop paths. Non-selected ink drops 92 travel along a non-selected (first) ink drop path 94 while selected ink drops 96 travel along a selected (second) ink drop path 98. A first electrode 114, positioned in ink delivery channel 40, positively charges ink 70 in any known manner prior to ink 70 being ejected from nozzle bore 46. As selected ink drops 96 travel along selected ink drop path 98, selected ink drops 96 pass by a second electrode 116 that is negatively charged. Positively charged selected ink drops 96 are attracted toward second electrode 116 as selected ink drops 96 pass by second electrode 116. In doing so, selected ink drops 96 alter their course and begin traveling along a resulting selected ink drop path 102. Again, resulting ink drop path divergence 110 between selected ink drops 96 and non-selected ink drops 92 is increased (as compared to ink drop path divergence 220 in FIG. 2A). Additionally, a resulting ink drop divergence angle (shown as angle D) between selected ink drops 96 and non-selected ink drops 92 is also increased (as compared to angle A in FIG. 2A). This is due to the attraction force of the oppositely charged second electrode 116 applied to the changed selected ink drops 96.

In this embodiment, selected ink drops 96 are shown as being allowed to strike recording medium 18 while non-selected ink drops 92 are shown as ultimately striking catcher 106. However, it is specifically contemplated, and therefore within the scope of this disclosure, that selected ink drops 96 can ultimately strike catcher 106 while non-selected ink drops 92 are allowed to strike recording medium 18. Additionally, charges on first and second electrodes 114 and 116 can also be reversed with equal results.

The invention has been described in detail with particular reference to certain preferred embodiments thereof, but it will be understood that variations and modifications can be effected within the spirit and scope of the invention.

PARTS LIST

10. Printer system
11. Image source
12. Image processing unit
14. Heater control circuit
16. Printhead
17. Ink gutter
18. Recording medium
19. Ink recycling unit
20. Transport system
22. Transport control system
24. Micro-controller
26. Ink jet pressure regulator
28. Ink reservoir
30. Ink channel device
40. Ink delivery channel
42. Substrate
46. Nozzle bore
50. Heater
51*a*. Heating element
51*b*. Heating element
56. Electrical insulating layer
59*a*. Connector
59*b*. Connector
60. Stream
61*a*. Connector
61*b*. Connector
64. Thin passivation film
68. Hydrophobizing layer
70. Ink
80. Ink drop deflection amplifier
81. gas source
82. Gas flow generating mechanism
84. Housing
86. Gas flow delivery channel
88. Gas flow
90. Gas flow coherence loss point
92. non-selected ink drops
94. non-selected ink drop path
96. selected ink drops
98. selected ink drop path
100. resulting non-selected ink drop path
102. resulting selected ink drop path
104. surface of catcher
106. catcher
108. surface of recording medium
110. resulting ink drop path divergence
112. attachment device
114. First electrode
116. Second electrode
200. printhead
202. pressurized ink source
204. selection device
206. selected ink drops
208. non-selected ink drops
210. selected ink drop path
212. recording medium
214. non-selected ink path
216. catcher
218. ink removal channel
220. ink drop path divergence
221. inconsistent ink drop deflection
222. ink
A. ink drop divergence angle
D. resulting ink drop divergence angle

What is claimed is:

1. An ink drop deflector mechanism comprising:

a source of ink drops;

a path selection device operable in a first state to direct ink drops from the source along a first path and in a second state to direct drops from the source along a second path, said first and second paths diverging from said source; and a system which applies force to drops travelling along said first and second paths, said force being applied in a direction such as to increase the divergence of said first and second paths, said system including a gas source which generates a gas flow, said gas flow being applied in a direction such as to increase the divergence of said paths.

2. The ink drop deflector mechanism according to claim 1, wherein said gas flow is positioned between said first and second paths.

3. The ink drop deflector mechanism according to claim 1, wherein said gas flow is substantially laminar.

4. The ink drop deflector mechanism according to claim 3, wherein said substantially laminar gas flow interacts with said first and second paths as said substantially laminar gas flow loses its coherence.

5. The ink drop deflector mechanism according to claim 1, further comprising:

a catcher, wherein at least a portion of said system is positioned adjacent said catcher.

6. The ink drop deflector mechanism according to claim 1, wherein said path selection device includes a heater.

7. The ink drop deflector mechanism according to claim 6, wherein said heater is an asymmetric heater.

8. An ink drop deflector mechanism comprising:

a source of ink drops;

a path selection device operable in a first state to direct drops from the source along a first path and in a second state to direct drops from the source along a second path, said first and second paths diverging from said source;

a system which applies force to drops travelling along at least one of said first and second paths, said force being applied in a direction such as to increase the divergence of at least one of said first and second paths; and a catcher, wherein at least a portion of said system is integrally formed in said catcher.

9. The ink drop deflector mechanism according to claim 8, wherein said path selection device includes a heater operable to produce said ink drops travelling along said first and second paths.

10. A method of increasing divergence in ink drops comprising:

providing a source of ink drops;

directing the ink drops to travel in a first state along a first path and in a second state along a second path, the first and second paths diverging from the source; and causing the divergence of at least one of the first path and the second path to increase by generating a gas flow and applying the gas flow to drops travelling along at least one of the first and second paths in a direction that increases the divergence of the paths.

11. The method according to claim 10, wherein generating the gas flow includes generating a substantially laminar gas flow.

12. The method according to claim 10, wherein applying the gas flow includes applying the gas flow as the gas flow loses its coherence.

13. The method according to claim 10, wherein the gas flow is positioned between the first path and second path.

14. A method of increasing divergence in ink drops comprising:

providing a source of ink drops;

directing the ink drops to travel in a first state along a first path and in a second state along a second path, the first and second paths diverging from the source; and causing the divergence of at least one of the first path and the second path to increase by applying a force to drops travelling along at least one of the first and second paths, wherein applying the force includes positioning a gas flow between the first and second paths.

15. The method according to claim 14, further comprising:

providing a catcher, and positioning at least a portion of the force adjacent the catcher.

16. A method of increasing divergence in ink drops comprising:

providing a source of ink drops;

directing the ink drops to travel in a first state along a first path and in a second state along a second path, the first and second paths diverging from the source; and causing the divergence of the paths to increase, wherein causing the divergence of the paths to increase includes positioning a gas flow between the first and second paths and applying the gas flow to the first and second paths as the gas flow loses its coherence.

* * * * *